US007945996B2

(12) United States Patent
Gunderson

(10) Patent No.: US 7,945,996 B2
(45) Date of Patent: May 24, 2011

(54) SELF-CLOSING HINGE

(75) Inventor: Joshua Gunderson, Boise, ID (US)

(73) Assignee: Boise State University, Boise, ID (US)

( * ) Notice: Subject to any disclaimer, the term of this patent is extended or adjusted under 35 U.S.C. 154(b) by 353 days.

(21) Appl. No.: 12/099,141

(22) Filed: Apr. 7, 2008

(65) Prior Publication Data

US 2008/0276424 A1 Nov. 13, 2008

Related U.S. Application Data

(60) Provisional application No. 60/922,285, filed on Apr. 5, 2007.

(51) Int. Cl.
*E05F 1/02* (2006.01)

(52) U.S. Cl. ..... 16/312; 16/303; 16/309

(58) Field of Classification Search ..... 16/303, 16/309, 310, 312, 316, 304, 306; 49/386, 49/239, 236–238; 312/326, 327, 321.5
See application file for complete search history.

(56) References Cited

U.S. PATENT DOCUMENTS

| | | | | |
|---|---|---|---|---|
| 1,108,298 A | | 8/1914 | Winter | |
| 3,107,758 A | * | 10/1963 | Benham | 49/386 |
| 3,292,204 A | * | 12/1966 | Tansey | 16/263 |
| 3,518,716 A | * | 7/1970 | Larson | 16/284 |
| 3,733,650 A | * | 5/1973 | Douglas | 16/312 |
| 3,748,688 A | * | 7/1973 | Berkowitz | 16/247 |
| 3,975,794 A | | 8/1976 | Kaiser et al. | |
| 4,030,161 A | * | 6/1977 | Loikitz | 16/284 |
| 4,631,777 A | * | 12/1986 | Takimoto | 16/315 |
| 4,991,259 A | | 2/1991 | Finkelstein et al. | |
| D554,470 S | | 11/2007 | Forgeon | |
| D557,104 S | | 12/2007 | Forgeon | |

FOREIGN PATENT DOCUMENTS

| | | | |
|---|---|---|---|
| GB | 2281099 A | * | 2/1995 |
| JP | 2002030856 A | * | 1/2002 |

OTHER PUBLICATIONS

Excerpts from website: http://seniordesign.engr.uidaho.edu/2005_2006/refrigeratorraiders, Aug. 2005.

* cited by examiner

*Primary Examiner* — Chuck Y. Mah
(74) *Attorney, Agent, or Firm* — Pedersen and Company, PLLC; Ken J. Pedersen; Barbara S. Pedersen

(57) ABSTRACT

A compact and aesthetically-pleasing self-closing door hinge comprises a gravity-assist feature and preferably a spring-assist feature, wherein the spring may be easily adjustable, replaceable, and even left out of the hinge. The preferred embodiment is reversible for easily changing from a right-opening to a left-opening door, and includes hinge lift-off capability, wherein the door and the blade connecting the door to the hinge body may be lifted up off the body of the hinge without any significant disassembly of the hinge. The spring is preferably placed around the gravity-assist cams of the hinge, rather than above or below the cams, which arrangement significantly reduces the overall height of the hinge with only slightly increased diameter of the hinge main body. The preferred hinge has no bolts or other fasteners visible or protruding out from the main housing of the hinge, and the preferred hinge has no exposed spring sleeve.

7 Claims, 7 Drawing Sheets

*Lift cam detail*

*Pushrod detail*

SELF-CLOSING HINGE

This application claims priority of U.S. Provisional Patent Application, 60/922,285, filed Apr. 5, 2007, and entitled "Self-Closing Hinge", the entire disclosure of which is hereby incorporated herein by this reference.

BACKGROUND OF THE INVENTION

1. Field of the Invention

The present invention relates generally to door hinges, and more specifically to self-closing hinges equipped with springs. While the invented hinge may benefit many self-closing door applications, preferred embodiments are especially beneficial for commercial, walk-in freezer doors.

2. Related Art

Many door hinges have been developed that comprise a self-closing feature for urging a door toward a closed position. This feature may be included on doors for reasons of safety, privacy, convenience, and/or energy-savings, for example, in hospitals, rest homes, public restrooms, and walk-in and other freezers. Several self-closing hinges have been patented in the past, including Winter (U.S. Pat. No. 1,108,298); Benham (U.S. Pat. No. 3,107,758); Berkowitz (U.S. Pat. No. 3,748,688, assignee Kason Hardware Corporation); Kaiser (U.S. Pat. No. 3,975,794, assignee Vollrath Refrigeration Company); and Loikitz (U.S. Pat. No. 4,030,161, assignee Buildex Incorporated). These patents are discussed in more detail later in this document.

Means by which door hinges are made to include a self-closing feature typically fall within two categories, that is, 1) a cam/slanted surface that tends to swing the door toward a closed position when gravity pulls the door and its hinge portion downward relative to the stationary hinge portion and surrounding stationary structure; and 2) a spring-bias that urges the door closed. The first is frequently called "a gravity hinge" and the latter is frequently called "a spring hinge."

In hinges that utilize gravity to assist/urge the door into the closed position, a helical-cut lift-cam surface is typically included in the hinge, which lift-cam surface causes the door to rise slightly as it is swung open by a user. When the door is released, gravity causes the door to swing closed, as the hinge portion connected to the door, in effect, slides down the lift-cam surface as it rotates.

In hinges that utilize spring-bias to assist/urge the door into the closed position, a spring is typically included in the hinge. The spring is positioned and adapted so that the door swinging open tends to move the spring into a position of potential energy that, when the door is released, works to close the door.

Walk-in freezer doors often are equipped with self-closing hinges that comprise both gravity-assist and spring-bias features. Hinges with a cam-based gravity-assist feature and the resulting raising of the door during opening, can be especially beneficial in a freezer because it helps keep the freezer door, and any seals on the doors bottom edge, from scraping against the floor. In a walk-in freezer, wherein it is desirable to not have a raised threshold in the doorway, the door and its bottom seal will tend to be at, or very close to, the level of the floor. Repeated opening and closing of the door, without raising the door slightly, would quickly damage the sealing capability of the door, and the cam-based gravity-assist feature helps prevent this.

Adding a spring-assist feature to the freezer door hinge supplements the self-closing feature, to increase the likelihood that the freezer door will reliably close. Walk-in freezer doors are insulated with foam and are surprisingly light for their large size, which poses the problem of the door not latching properly. The gravity force acting on a lightweight door (to close it with the aid of its gravity-hinges) is not as great as it would be on a heavy door, and, since a freezer is, in effect, an airtight room, air rushes to escape the freezer as the door nears the fully-closed position. This sudden rush of air can slow the door down so much that it does not have enough momentum to latch on its own. For this reason, springs are typically incorporated into the door hinges to assist the cam-based gravity-assist in closing the door. In currently-available freezer hinges, these springs are presently positioned either above or below the cams, so that, when the cams "separate" (slanted surfaces sliding relative to each other, during rotation typically of one of the cams, so that the over-all length of the cam system structure increases) as the door opens, the spring compresses so that the spring's force tends to force the cams to move "back together" to close the door (slanted surfaces sliding relative to each other during rotation of said one of the cams in the opposite direction so that the over-all length of the cam system structure decreases).

Prior art hinges place the spring entirely above or below the cam, which extends the overall height of the hinge by a substantial amount, for example, 2 to 3 inches compared to some hinge embodiments invented by the present inventors. The extra height in present hinge designs usually takes the form of a sleeve for the spring that moves like a plunger as the door opens and closes (for example, see the hinge available from Kason Industries, Inc., Shenandoah, Ga., USA, model 1248, shown in FIG. 1A). The Kason hinge is not adapted for convenient removal or adjustment of the spring, but it does have lift-off capability (allowing the door and blade to be lifted off the hinge housing without removing any hardware). The hinge available from Component Hardware Group, Inc., Lakewood, N.J., USA, (Components model W-62, shown in FIG. 1B) has a plunging bolt, but it is enclosed in a stationary cylinder above the blade. The Component hinge has an adjustable, removable spring, but it has the disadvantages that the retaining nut is clearly visible and that the hinge is not a lift-off design. The Kason and Component hinges are discussed in more detail below.

The first introduction of the spring to a gravity-driven, self-closing door that is known to the inventors is seen in U.S. Pat. No. 1,108,298 by Winter, who points out that spring assistance is necessary in applications where the weight of the door is insufficient. U.S. Pat. No. 3,107,758 by Benham disclosed a hinge wherein the spring is placed above the cams and the door may not be removed by simply lifting it off the hinges. The Benham hinge, however, is not designed for use on commercial freezer doors and requires built-in receiving brackets.

A hinge tailored to freezer doors is seen in U.S. Pat. No. 3,748,688 by Berkowitz. The Berkowitz design is still in use by Kason Industries and Berkowitz patent number can be seen printed on the blade of the Kason model #1248 hinge. In Berkowitz is seen the now-familiar helical cam pair, noncircular lifting pin or pushrod, and right- or left-hand operation. Note also that this Berkowitz hinge is a lift-off design. Missing from the Berkowitz hinge is a spring to assist in closing; the inventors believe that the Berkowitz hinge lacks the additional closing force necessary to properly latch a light door when the door is allowed to self-close.

Following Berkowitz were others working to refine freezer door hinges. U.S. Pat. No. 3,975,794, by Kaiser, places the spring above the cams again and simply adds torsion to compression with regard to the spring when the door is opened. In this case, the spring life is shortened by the torsional loading. The additional force provided by the torsional loading, although likely to be unnecessary in modem door hinges, could easily be matched by the capability of embodiments of the instant invention to allow springs of larger wire diameter and higher spring rates. Finkelstien (U.S. Pat. No. 4,991,259) also places a spring at the top of the hinge in a protruding spring shell. Neither Kaiser nor Finkelstien is a lift-off hinge.

U.S. Pat. No. 4,030,161 by Loikitz appears to be the design presently used by Component Hardware Group, although there is no patent number printed on the Component brand W-62 hinge (shown in FIG. 1B). The spring used in the Loikitz patent is believed by the inventors to be too small to contribute sufficiently to the closing force. Modern Component brand hinges use a much larger spring than is shown in Loikitz and that is encased in a sleeve that protrudes from the top of the blade (as seen in FIG. 1B). This protruding spring sleeve, as mentioned previously, introduces an aesthetics problem. In addition, the Loikitz design and the Component brand hinge do not result in a lift-off hinge and do not conceal the large nut attached to the threaded bolt that passes through the entire mechanism.

There exist many prior works involving spring and cam arrangements designed to keep a door from rising during opening. Contrary to such teachings to eliminate the rise, a rise is actually preferred in freezer doors, as it prolongs the life of the lower door seal by preventing sliding contact with the floor.

Still, even in view of the many prior art hinges, the inventors believe that there is a need for a more compact and aesthetically-pleasing door hinge that comprises a gravity-assist feature and preferably also a spring-assist feature. The inventors believe that there is still a need for a door hinge that may be used with or without a spring, wherein, when in use with a spring, the spring is adjustable even through the preferred hinge is a reversible, lift-off hinge (spring adjustment and lift-off capability being mutually-exclusive in prior art hinges). The preferred embodiments of the invention meet these needs.

SUMMARY OF THE INVENTION

The invented hinge comprises a spring system that allows a smaller, simpler hinge design to include characteristics that are presently mutually exclusive in conventional hinges. Prior art hinge designs utilize a spring placement and overall connectivity that is less ideal than the preferred embodiments of this invention. In the present invention, the spring is placed at least partly, and preferably substantially, around the cams, rather than entirely above or below the cams. By placing the spring around the cams, the inventors have developed preferred embodiments with significantly reduced height, compared to the prior art, but with only slightly increased diameter. For example, the inventors' preferred embodiments have a hinge height about 2 to 4 inches less, and a cam housing diameter only about 0.25 to 0.5 inch more, than the hinge height and cam housing diameter of conventional walk-in freezer hinges. Thus, the preferred embodiments result in a smaller, more attractive design, with a smoother and simpler outer surface appearance.

The preferred embodiments of the hinge comprise cam surfaces for providing a gravity-assisted self-closing, and may also include a spring. The spring may be installed, removed, and/or adjusted by the user; the preferred hinge is functional with or without the spring. Also, the preferred hinge may receive springs of various dimensions and strengths as there is sufficient room in the spring-receiving space and tolerance in the connections/contact between the spring and the cooperating parts to allow different springs. The preferred embodiments are reversible, for being adapted to installation on left- or right-opening doors, and have no visible fasteners such as bolts heads or nuts, except for the machine screws that may be used to attach the base and the blade of the hinge to their respective portions of the door and door frame. The spring system allows the spring to be adjusted (without replacement with a different spring) or removed from the hinge entirely, without compromising lift-off capability. These features result in a more aesthetically pleasing appearance, added functionality, and possible material cost savings, compared to prior art self-closing hinges.

DETAILED DESCRIPTION OF THE PREFERRED EMBODIMENT

Figure 1B:
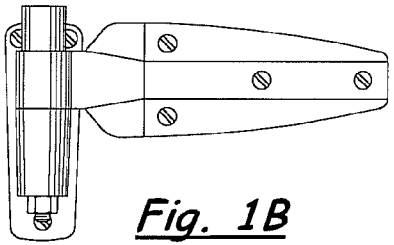
Fig. 1B (PRIOR ART)
FIGS. 1A and 1B represent pictures of two prior art hinges available from the Kason and Component companies, respectively.
Figure 2B:
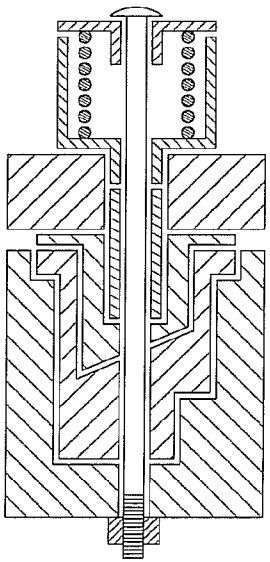
Fig. 2B (PRIOR ART)
FIGS. 2A and 2B represent cross-sectional views of the prior art hinges in FIGS. 1A and 1B, respectively.
Figure 1A:
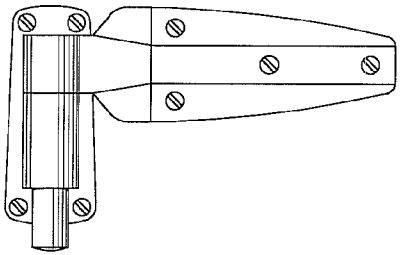
Fig. 1A (PRIOR ART)
Figure 2A:
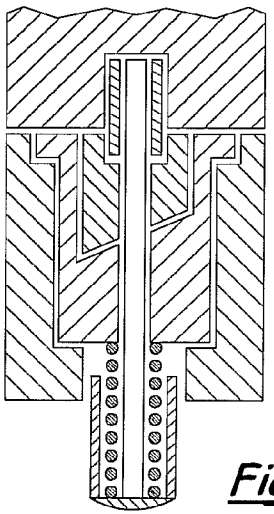
Fig. 2A (PRIOR ART)
Figure 1C:
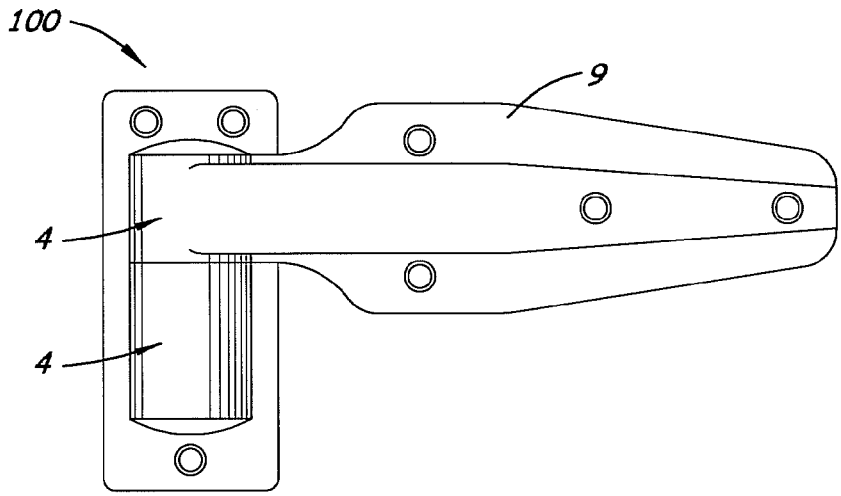
FIG. 1C is a plan view of one embodiment of the present invention, shown side-by-side with the prior art hinges of FIGS. 1A and 1B.
Figure 2C:
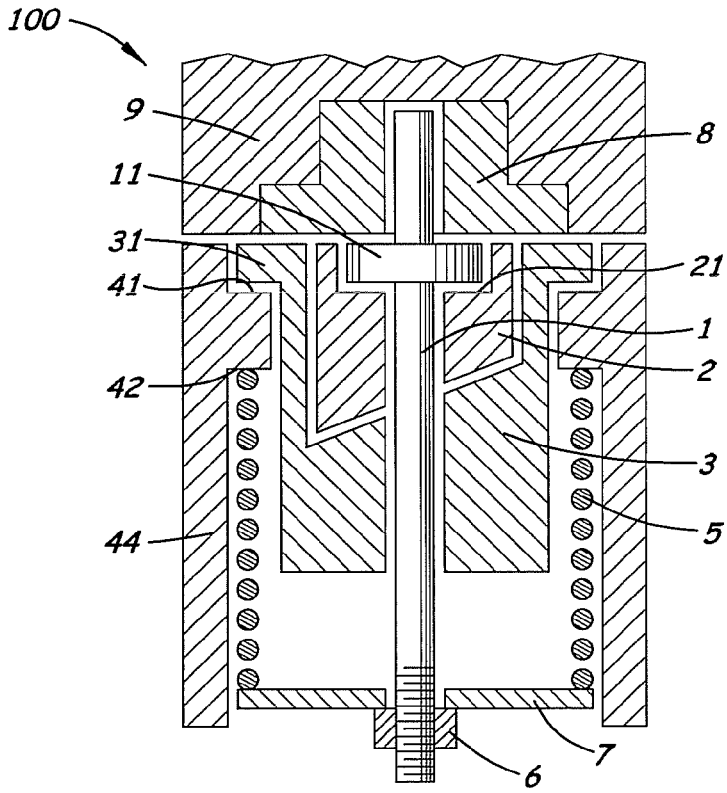
FIG. 2C is a schematic, cross-sectional view of the embodiment of the invented hinge of FIG. 1C, shown side-by-side with cross-sectional views of the prior art hinges of FIGS. 1A and 1B.

Referring to the Figures, there are shown several prior art hinges and one, but not the only, embodiment of the invented self-closing hinge 100.

The preferred embodiment 100 of the invented self-closing hinge, as shown best in FIGS. 2C, 3A, 3B, 6 and 7, comprises fitting of an upper cam 2 inside of a lower cam 3, the lower cam 3 being formed into a generally cylindrical cup with an outwardly-extending flange 31 that hangs on a shelf 41 built into the housing 44 of the hinge base 4. The top surfaces of the two cams 2, 3 are preferably coplanar with lifting surface 11, which are near and parallel to the lower surface of the insert 8, and the lower surface of the blade 9 portion that surrounds the insert 8 (see FIG. 2C). This way there is no gap between housing 44 and blade 9 when the door is fully closed. Also, a notch 33 provided in the lower cam 3 is cut into the flange 31, and said notch mates with a similarly-shaped portion 45 on the housing 44 so that the lower cam 3 does not rotate relative to the housing 44. This way, because the notch is near the top of the lower cam 3 in the flange 31 (and not placed in the lower end of the lower cam 3), the bottom end of the lower cam 3 and the housing 44 (nor the base 4) need not contact each other and need not be mated or otherwise secured to each other. This permits the cutting away of useless material in the lower part of the housing 44, thus, making room for the spring 5 to fit between the housing 44 and cams 2, 3. Also, the nut 6 tightens against the washer 7 and spring 5 rather than against the housing 44, which allows the nut 6 and washer 7 to be hidden from view within the housing 44 and covered with a plastic cap 110.

Figure 3A:
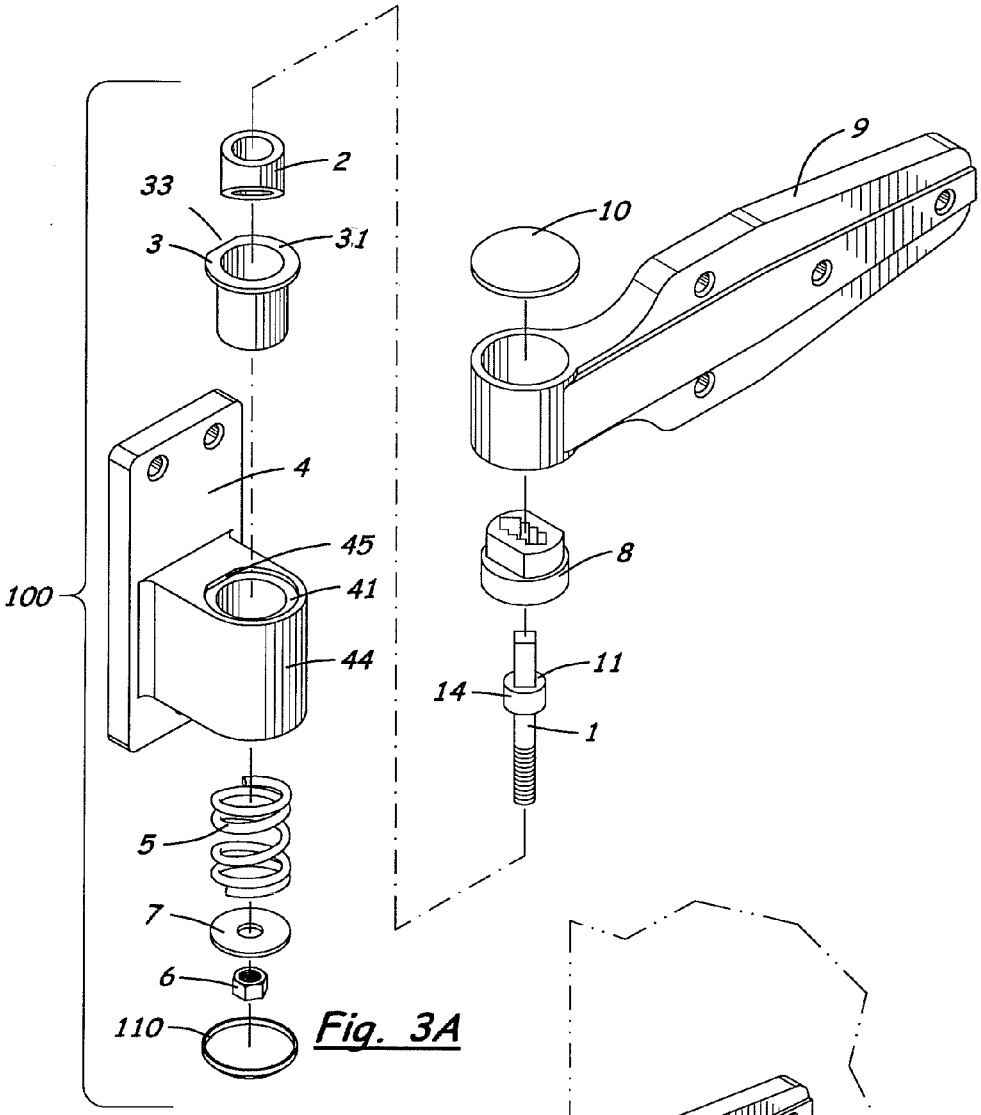
FIG. 3A is an exploded, perspective view of the embodiment of the invention of FIGS. 1C and 2C.
Figure 3B:
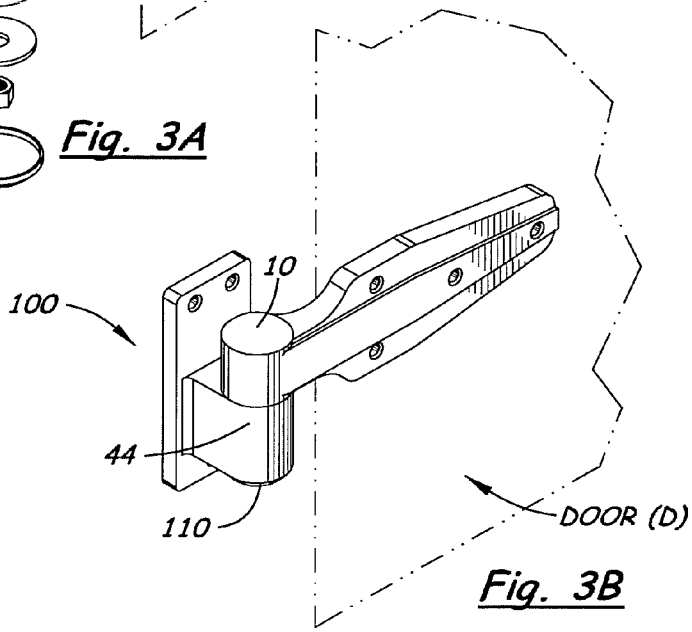
FIG. 3B is a perspective view of the embodiment of FIGS. 1C, 2C and 3A, illustrating attachment of the blade to a schematic door D.
Figure 3C:
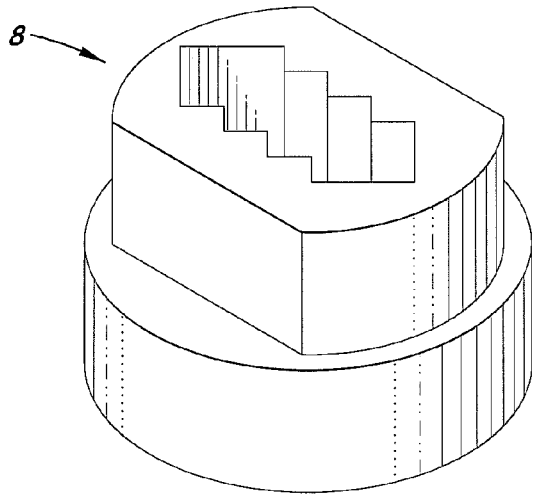
FIG. 3C is a perspective view of one embodiment of the preferred offset insert that is inserted into the blade, and that, in turn, receives the lift pin in its interior cavity to operatively connect the blade to the lift pin.
Figure 3D:
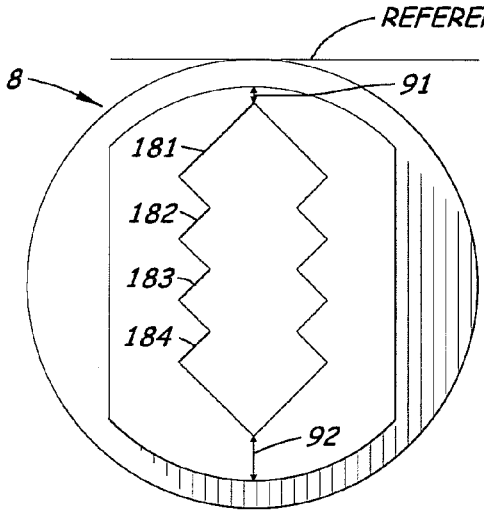
FIG. 3D illustrates the offset insert in one orientation.
Figure 3E:
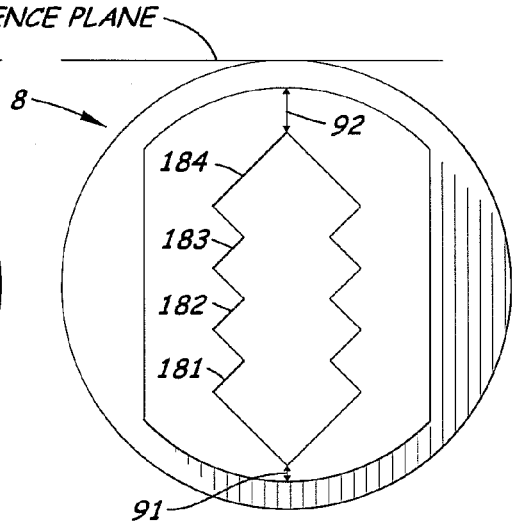
FIG. 3E illustrates the same offset insert rotated 180 degrees about an axis extending into the paper of these figures.
Figure 4:
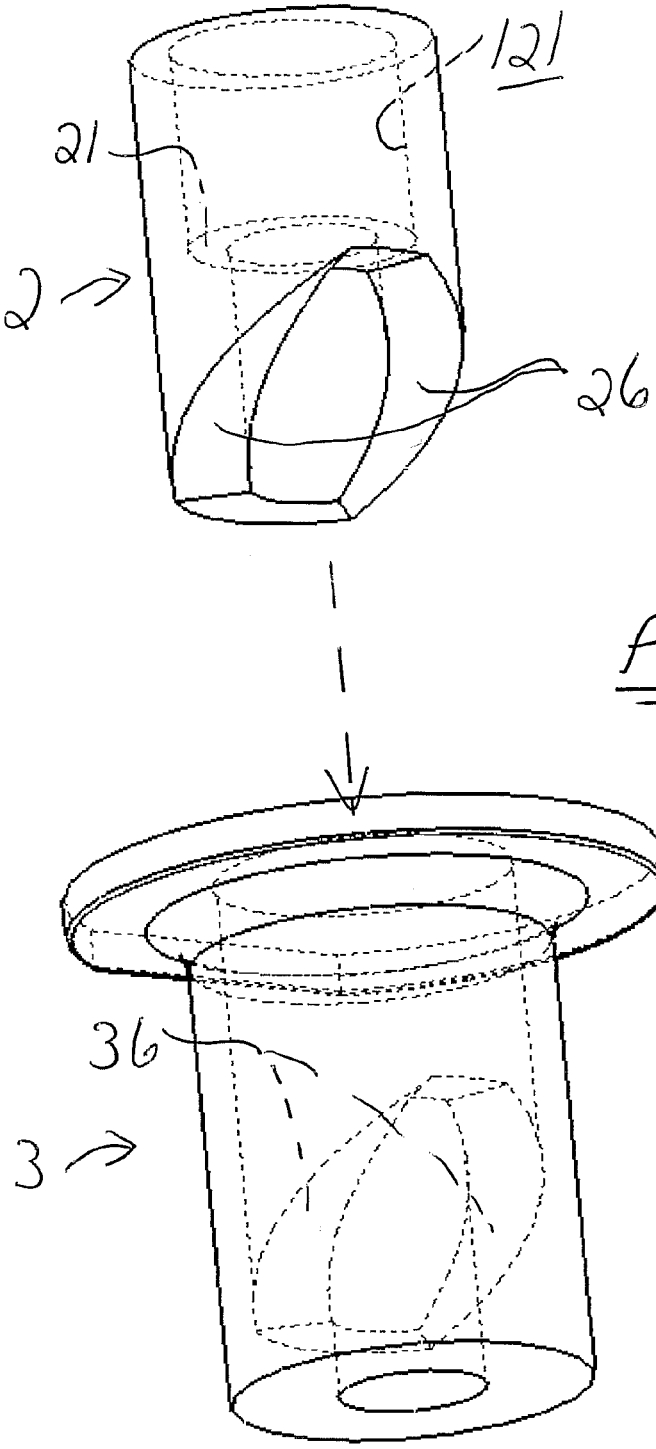
FIG. 4 is a detail exploded, perspective view of one embodiment of the lift cam system of the present invention, showing hidden lines as dashed lines.
Figure 5:
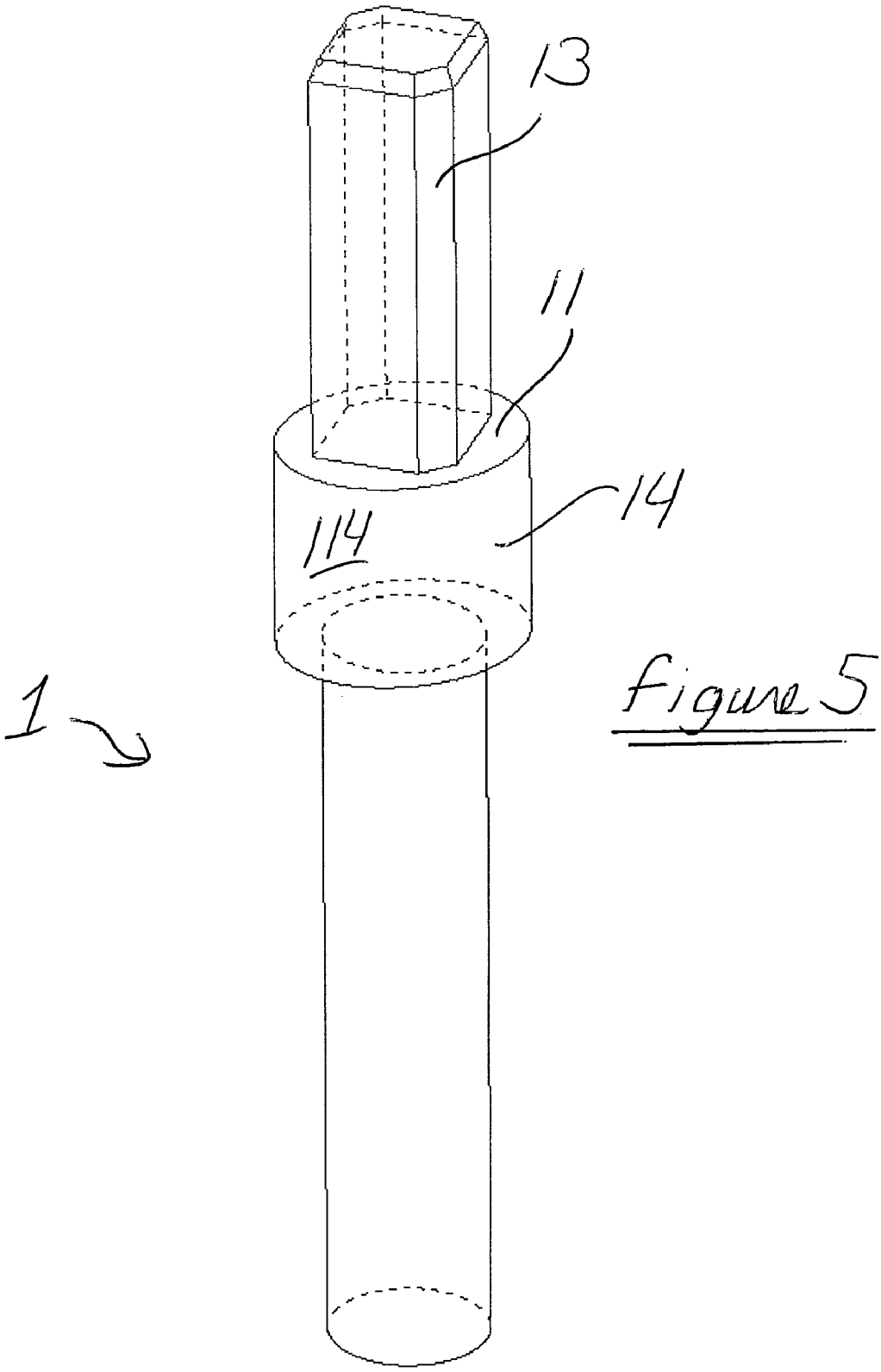
FIG. 5 is a detail, perspective view of one embodiment of push-rod of the present invention, showing hidden lines as dashed lines.
Figure 6:
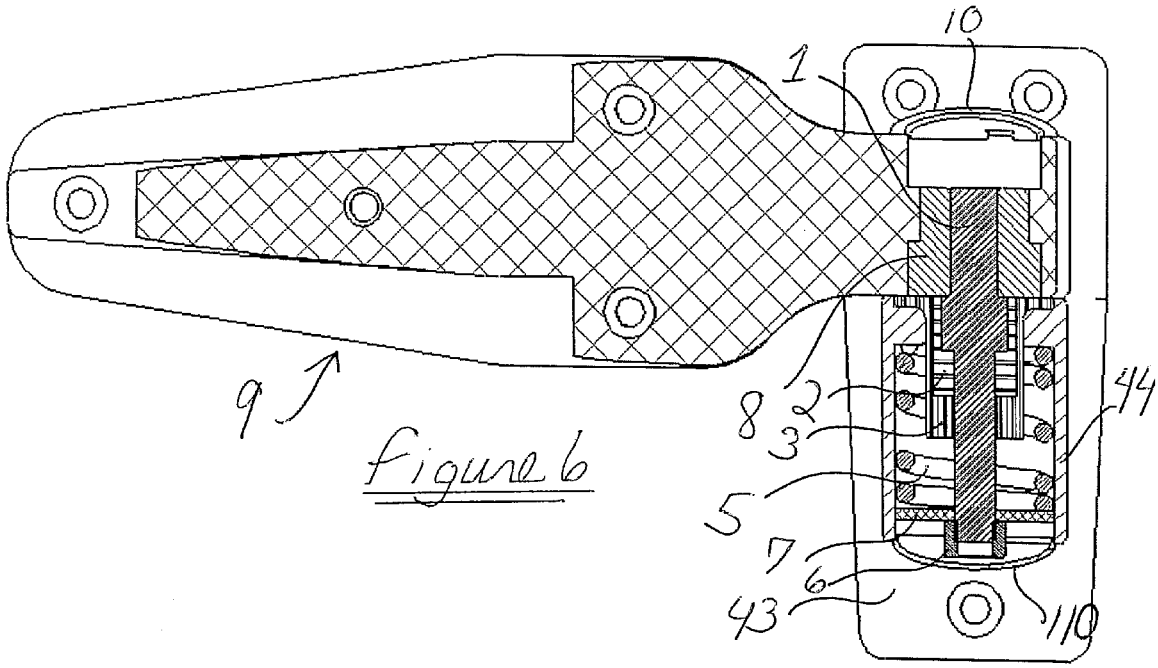
FIG. 6 is a front cross-sectional view of the embodiment of FIGS. 1C, 2C, and 3-5.
Figure 7:
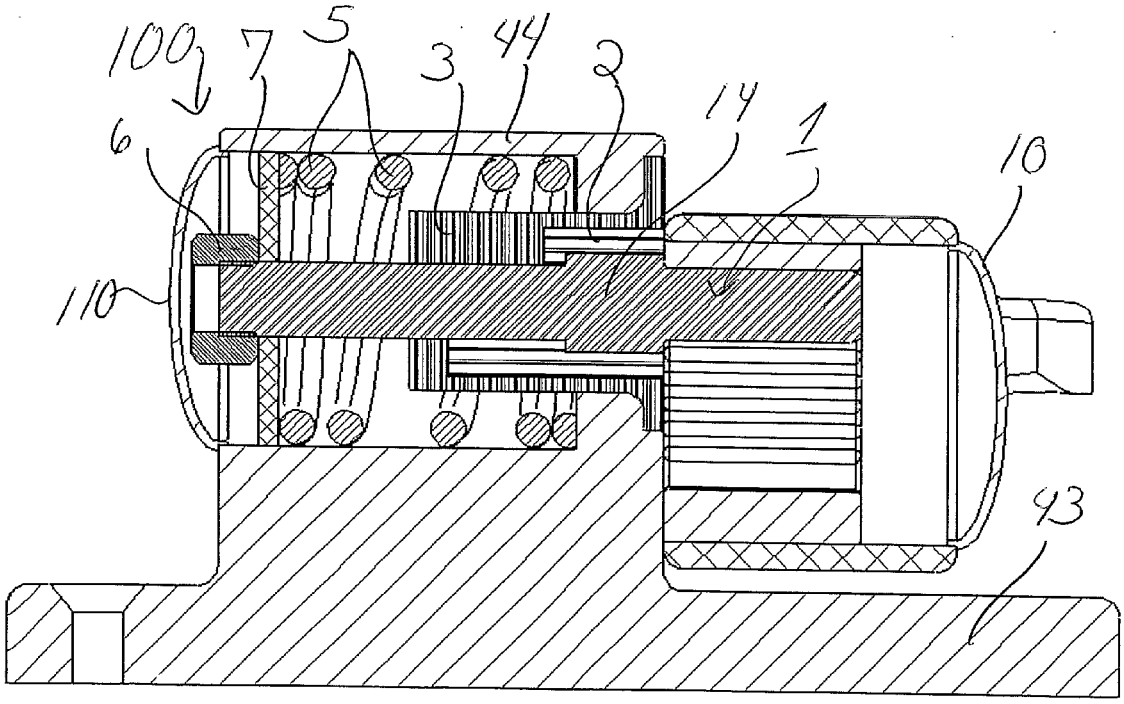
FIG. 7 is a side, cross-sectional view of the embodiment of FIGS. 1C, 2C, and 3-6.

The pieces-parts of the preferred embodiment are listed below by call-out number and described, with particular reference to FIGS. 3A, 3B, and 4-7:

1. Lift Pin (also called "pushrod")—Depending on the material chosen, the lift pin 1 could be sintered, machined, or injection molded, for example. The pin is made of a stronger metal than the base 4 and blade 9 to handle relatively high tensile and bending loads during operation of the hinge. The lift pin flange 14 extends radially out from the lift pin 1 to rest on a ledge 21 built into the upper cam 2. As the door D (see FIG. 3B) is opened by a user of the door D, rotation of the blade 9 (being the structure connecting the door to the lift pin 1 and upper cam 2), causes the upper cam 2 to ride up as it rotates relative to the lower cam 3, which relative movement of the slanted cam surfaces 26, 36 serves to lift the lift pin 1, and, in turn, also the blade 9 and door D to a slightly higher level than when the door is closed. The lift pin 1 top end (see the generally square end of the lift pin 1 in FIG. 5) is received in the offset insert 8 that is inserted into blade 9, and extends down through the entire hinge mechanism and attaches to the nut 6.
2. Upper Cam—The upper cam 2 is preferably injection-molded Delrin™ or another suitable material that will be understood by one of skill in the art. The upper cam 2 is constrained concentrically inside the lower cam 3, and the upper cam inclined surfaces 26, which are exterior bottom surfaces of the upper cam 2, rest on the lower cam inclined surfaces 36. The upper cam 3 turns ("rotates") as the door D turns. An adaptation is made in the hinge to prevent relative rotation between the upper cam 2 and the lift pin 1; preferably, this is done by shaping the ledge 21 in such a way that it holds/supports the lift pin flange 14 but does not allow relative rotation between the upper cam 2 and the lift pin 1. In the preferred embodiment, this shaping takes the form of the flange 14 having an outer surface 114 that is elliptical (in cross-section) rather than circular, and the inner surface 121 (which terminates at its bottom extremity at ledge 21, FIG. 4) also being elliptical (in cross-section) rather than circular. The flange 14 will fit into the space above the ledge 21, with surface 114 mating with surface 121 so that the flange 14 and the upper cam 2 will not rotate relative to each other, thus, operatively connecting the lift pin to the upper cam. Other non-circular surface shapes for surface 114 and surface 121 could also be used, but this simple elliptical shaping is very effective. The upper cam 2 is preferably made of Delrin™ because of self lubricating qualities of that material.
3. Lower Cam—The lower cam 3 is preferably injection-molded Delrin™, because of self-lubricating properties, or other suitable material that will be understood by one of skill in the art. The lower cam 3 rests on a ledge 41 built into the housing 44, with notch 33 in flange 31 mating with portion 45 of the housing 44 in such a way that rotation is not allowed between the lower cam 3 and the housing 44. The inclined surface 36 of the lower cam 3 is located at the interior bottom of the cup shape of the lower cam 3, said cup shape providing a radial constraint for the upper cam 2.
4. Base—The base 4 provides containment for the various components of the preferred hinge and an anchor structure for connection to the freezer body or other door frame structure surrounding the door. The base 4 may be injection molded Zinc alloy, or other suitable material that will be understood by one of skill in the art. The base 4 comprises a plate 43 for attachment to said freezer/body or door frame, and a generally cylindrical housing 44, protruding out from the plate 43, that encloses the cam and spring mechanism. In preferred embodiments, the plate 43 connects to the external freezer body wall with three machine screws.
5. Spring—Preferably, the spring 5 component can be purchased from a custom hardware manufacturer for cost savings. The spring 5 fits concentrically around the lower cam 3 and within the housing portion 44 of the base 4. When the door D is opened, the spring 5 is compressed between the stationary underside 42 of the ledge within the housing portion 44 and the washer 7 that is connected to and rises with the lift pin 1. Thus, when the door D is opened, the blade 9 rotates together with the upper cam 2 and the lift pin 1 (with no relative movement between these parts), and so the lift pin 1 (being raised by the cam surfaces as the slanted cam surfaces slide relative to each other to "separate," lengthening the overall length of the cam system) compresses the spring 5. This compression of the spring 5 provides a bias that urges the reverse operation, that is, rotation of the upper cam 2 with the lift pin 1 in the opposite direction to a position where the cam surfaces slide relative to each other to be "back together" (shortening the overall length of the cam system). In addition, by adjusting the position of the nut 6 and washer 7 on the bottom end of the lift pin 1, various amounts of compression of the spring may be provided even when the hinge is in the door-closed position.
6. Nut—This may be a common nut, as in a cooperating nut and bolt. The nut 6 retains washer 7 by threading onto the end of the lift pin 1. This nut 6 is preferably hidden from view by being received inside the lower end of the housing 44 and covered by lower cap 110.
7. Washer—This component can be purchased from a custom hardware manufacturer for cost savings. The washer fits concentrically over the end of the lift pin 1, and is secured between the lower end of the spring and the nut via the threaded connection of the nut 6 to the lift pin 1. The washer 7 serves to compress the spring, as the lift pin 1 rises due to the cam action. Adjusting the initial spring 5 compression (present prior to opening of the door) may be done by threading the nut (and sliding the washer) farther up on the lift pin.
8. Offset Insert—For longevity and safety, a cast steel might be best for the offset insert 8, but injection-molded zinc alloy or similar substitute may also suffice. The offset insert 8 fits into the blade 9. As shown to best advantage in the schematic top view of FIGS. 3D and 3E, the offset insert 8 comprises multiple square cutouts 181, 182, 183, 184 through its body, wherein the lift pin upper end 13 may be inserted into any of said square cutouts so that the outer, square (in cross section) pin end 13 will mate with the chosen cutout for operative connection of the insert 8 to the pin (via end 13). The cutouts 181, 182, 183, 184 are overlapping, but, because of their shapes, the pin end 13 will not slide from cutout to cutout—rather the pin end 13 may be moved to another cutout only upon removal of the pin from, and reinsertion into, the insert 8. The relative position of the cutouts 181, 182, 183, 184 to each other allows the door to be positioned at one of four different offset positions in ¼ inch increments (by moving the pin end 13 into the four various cutouts as may be seen in FIGS. 3C-E, for example). Preferably, the offset insert 8 may be designed so that it can be removed from the blade and rotated 180 degrees (illustrated by the arrow in FIG. 3D) for re-insertion into the blade 9 so that the same cutouts (now rotated 180 degrees due to the insert being rotated 180 degrees to reside in the orientation shown in FIG. 3E) become available for four different offsets, thus, providing a total of eight offset positions in ⅛ inch increments. In FIGS. 3D and 3E, this is illustrated by showing the offset insert 8 in position relative to a reference plane, whereby one may see that each cutout 181, 182, 183, 184 is a different distance from the reference plane in FIG. 3D, and, when the insert 8 is rotated into the position in FIG. 3E, the four cutouts are all slightly farther from the reference plane, resulting in a total of 8 possible positions, relative to the reference plane, for the pin that will be inserted into the cutouts. This is made possible by having the set of cutouts 181, 182, 183, 184 located in the insert 8 at a different distance from one perimeter edge 91 than from the opposing perimeter edge 92, for example. Upon rotation, therefore, the cutouts 181-184 are shifted a slight amount (preferably ⅛ inch) relative to a reference plane (such as the plate 43), thus, providing the second set of four offset distances (offset from the first four by ⅛ inch). Other cutout shapes besides squares may be used, with the pin end 13 being a cooperating shape.

9. Blade—The blade 9 is preferably injection-molded zinc alloy. Typically, the blade is the same material and made by the same manufacturing process as the base 4. Sometimes a blade for a hinge may be called a "strap," although perhaps this blade 9 is shorter than most "straps." The blade 9 attaches to the door with four machine screws and transmits lifting and turning force between the door and hinge. The top and bottom halves of the blade are preferably symmetrically-shaped, so that, upon removal of the upper cap 10, the blade may be lifted up off of the lift pin 1 and housing 44, and switched, for example, from the orientation in FIG. 3B to point in the opposite direction for connection to an oppositely-opening door.

10. Upper Cap—This upper cap 10 may be an ABS plastic molded aesthetic cover that fits inside the exposed hole in the blade (the top end of the blade bore). There may be a notch in the upper cap 10 to aide in removal. This cap 10 must be removed in order to transition between right and left handed operation by switching the direction of the blade 9 relative to the base 4.

11. Lower Cap—This lower cap 110 may be an ABS plastic molded aesthetic cover that fits inside (or over) the exposed hole in the bottom of the base beneath the washer 7 and nut 6. There may be a notch in the lower cap 110 to aide in removal. This lower cap 110 must be removed to insert, remove, or replace the spring or to adjust the initial spring compression. By removing the lower cap 110, removing the nut 6 and washer 7, the spring is exposed and may be easily removed and replaced. By threading the nut farther up onto the lift pin 1 (which pushes and retains the washer farther up in the housing 44), the initial spring 5 compression may be adjusted (in effect, by compressing the spring more or less to start with).

Note that the preferred hinge operating parts are symmetrical about a longitudinal plane that is perpendicular to the plate 43 (and the wall, freezer/body, or door frame to which the hinge plate 43 is attached) to allow both right and left handed operation/movement of the hinge.

Preferably, the spring 5 encircles the outer surface of the lower cam 3, so that the spring reaches up inside the housing 44 to an extent that it extends at least half way along the axial length of the lower cam 3, and more preferably ½-⅔ of the way up from the bottom surface of the lower cam toward the top surface of the lower cam. As the upper cam 2 is received inside the cup-shaped structure of the lower cam 3, one may also say that the spring preferably reaches up inside the housing 44 to a location approximately at or above the cammed surfaces of the cams 2, 3 (when they are in the door-closed position). A lower portion of the spring extends down past the bottom of the lower cam 2, to leave room between the lower cam 3 and the washer 7 for the lift pin 1 and the washer 7 and nut 6 to move when the door D opens. The spring is of greater diameter than both the lower cam 3 and the upper cam 2, as the preferred spring fits around the outer side wall of the outermost of the cams (here, lower cam 3).

It may be seen that the preferred embodiments of the present invention may operate even with the spring removed but with no other hardware changes (besides removing or eliminating the spring), because the gravity-assist cam feature is present and operable without the spring. Optionally, a spring add-on kit purchased by the consumer may contain only the spring itself, to convert a spring-less hinge according to embodiments of the invention to a spring-assisted hinge according to embodiments of the invention. It will not be visually apparent without disassembly of the hinge (removing the lower cap 110) whether there is a spring present or not.

The preferred hinge may be said to be a "reverse-action spring" hinge, because of the operation of the spring comprises the spring being compressed (shortened) when the cam system lengthens and the spring becoming relaxed (lengthening, less compression) when the cam system shortens. It is this bias of the spring that urges the cam system to shorten and, in view of the operative connections between the hinge components, to cause swinging of the blade and the door to a closed position.

It may be said that, when an object is to be connected to a spring and located in the approximately the same location as that spring, the simplest connection is to mate the top of the object to the top of the spring and to mate the bottom of the spring to the bottom of the object. Then, if the object elongates (lengthens), the spring stretches (tension). However, springs do not work best in this mode, and, instead, are better in compression. The inventors have made the spring in their hinge a reverse-action spring, wherein lengthening of the object to which the spring is connected causes shortening (compression) of the spring, rather than the opposite. The top of the present inventors' cam system is thus operatively connected to the bottom of their spring, and the bottom of their cam system is operatively connected to the top of the spring. In conventional devices, a spring clip may be used to connect to the outside of a spring to an object. The inventors, on the other hand, have invented a unique way of positioning and operatively connecting their reverse-action spring. As described and portrayed elsewhere in this Description, this unique system comprises placing the spring substantially around the cam system, and adapting the housing/casing of the hinge components to provide a shelf on which the lower cam rests while the top of the spring abuts against (and is compressed against) preferably the same shelf. Further, the system comprises the bottom of the spring being operatively connected to the lift pin and, hence, to the upper cam, via the washer system.

In the preferred embodiments, the uppermost portions of the hinge, except for a portion of the plate 43, is the upper cap 10 immediately on top of the blade. There is no spring above the blade and no spring sleeve, shell, or cover protruding up or down from the main body/housing of the hinge (in other words, the preferred hinge has no exposed spring sleeve). Also, the preferred spring, which is below the blade, is entirely contained within the housing 44, and there is no need for a spring shell or cover protruding down from the housing that contains the cams. Therefore, the housing 44 has the appearance of a compact, neat, single-exterior-diameter unit, without unsightly protrusions and variations in external diameter of the main body of the hinge.

Although this invention has been described above with reference to particular means, materials, and embodiments, it is to be understood that the invention is not limited to these disclosed particulars, but extends instead to all equivalents within the scope of the following claims.

I claim:

1. A self-closing hinge, comprising a hinge housing, adapted for securement to a door frame;

a hinge blade with a blade distal end and a blade proximal end, with the blade distal end being adapted for securement to a door, the door being adapted to open and close within the door frame, and the blade proximal end being secured to a first end of a pushrod, so that the hinge blade rotates when the pushrod rotates and vice-versa;

the pushrod being secured to a first cam member with a first cam surface so that the first cam member rotates when the pushrod rotates and vice-versa;

a second cam member with a second cam surface secured within the hinge housing, the second cam member having an open end for receiving within it the first cam member and the first cam surface so that the first cam surface contacts the second cam surface, the open end of the second cam member also receiving within it a portion of the pushrod, a second end of the pushrod being connected to one end of a spring which is contained within the hinge housing, the spring at least partly surrounding both the first and second cams.

2. The hinge of claim 1 further comprising an insert within the blade proximal end that receives the first end of the pushrod, the insert having a plurality of cutouts axially through its body for selectively receiving the first end of the pushrod, so that securement of the proximal end of the hinge blade to the first end of the pushrod is adjustable perpendicularly to the centerline of the pushrod.

3. The hinge of claim 1, wherein each of said first cam member and said second cam member has an uppermost surface near the blade proximal end, wherein said uppermost surface of the first cam member and the upper most surface of the second cam member are generally co-planar when the hinge is rotated to a door-closed position.

4. The hinge of claim 3, wherein the blade proximal end has a lowermost surface near said uppermost surface of the first cam member and also near said uppermost surface of the second cam member, and wherein, when the hinge is rotated to a door-closed position, no gap is present between said first and second cam members and said lowermost surface of the blade proximal end.

5. The hinge of claim 3, wherein the first cam member is entirely contained within the second cam member when the hinge is rotated to a door-closed position.

6. The hinge of claim 1, wherein the first cam member is contained entirely within the second cam member when the hinge is rotated to a door-closed position.

7. The hinge of claim 1, wherein the spring does not extend beyond said housing and said hinge does not comprise a spring housing separate from said housing.

* * * * *